US005713283A

United States Patent [19]

Eltner et al.

[11] Patent Number: 5,713,283

[45] Date of Patent: Feb. 3, 1998

[54] METHOD AND DEVICE FOR REALIZING NON-STOP OPERATION AT A DELIVERY OF A SHEET-FED PRINTING PRESS

[75] Inventors: Bruno Eltner, Heidelberg; Mario Schuster, Leimen; Peter Gamperling, Bammental, all of Germany

[73] Assignee: Heidelberger Druckmaschinen AG, Heidelberg, Germany

[21] Appl. No.: 643,638

[22] Filed: May 6, 1996

[30] Foreign Application Priority Data

May 4, 1995 [DE] Germany ..... 195 16 071.1

[51] Int. Cl.[6] ..... B65H 31/12

[52] U.S. Cl. ..... 101/232; 271/218

[58] Field of Search ..... 271/218; 101/232

[56] References Cited

U.S. PATENT DOCUMENTS

| | | | |
|---|---|---|---|
| 4,796,879 | 1/1989 | Martini et al. | 271/218 |
| 5,074,743 | 12/1991 | Schaffner et al. | 414/790.8 |
| 5,131,647 | 7/1992 | Henn et al. | 271/18.9 |

FOREIGN PATENT DOCUMENTS

| | | | |
|---|---|---|---|
| 2441 459 A | 3/1976 | Germany | 271/218 |
| 1090650 | 5/1984 | U.S.S.R. | 271/218 |
| 861133 | 2/1961 | United Kingdom . | |
| 1 519 009 | 7/1978 | United Kingdom . | |
| 1 526 615 | 7/1978 | United Kingdom . | |
| 2 079 259 | 1/1982 | United Kingdom . | |

*Primary Examiner*—Edgar S. Burr
*Assistant Examiner*—Dave A. Ghatt
*Attorney, Agent, or Firm*—Herbert L. Lerner; Laurence A. Greenberg

[57] ABSTRACT

Method of changing sheet piles on a sheet-fed printing press, which includes introducing a sheet pile rake above a main sheet pile for forming an auxiliary sheet pile, further includes laying at least one rotatably mounted wedge on an upper edge of the main sheet pile so as to form a wedge-shaped space; and device for performing the foregoing method.

11 Claims, 2 Drawing Sheets

METHOD AND DEVICE FOR REALIZING NON-STOP OPERATION AT A DELIVERY OF A SHEET-FED PRINTING PRESS

BACKGROUND OF THE INVENTION

Field of the Invention

The invention relates to a method and device for realizing non-stop operation at a delivery of a sheet-fed printing press.

A non-stop operation is realized in accordance with the state of the art by introducing a sheet-pile rake above a previously existing main sheet pile, for the purpose of forming an auxiliary sheet pile. Thereafter, the main sheet pile is removed and a new pallet is laid on a pile-lifting device of the sheet-fed printing press. After moving the pallet upwards to a location immediately underneath the sheet-pile rake, the latter is withdrawn.

For the purpose of inserting the sheet-pile rake, it is necessary to form a wedge-shaped space between the previously existing main sheet pile and the succeeding further produced printed sheets. Furthermore, the main sheet pile is lowered simultaneously. Heretofore, this wedge-shaped space has been formed by introducing sheet-catching devices which are required, inter alia, for removing sample or proof sheets. Due to the high production speeds, the problem arises that the section or layer of sheets formed by the subsequently produced printed sheets becomes so heavy that it cannot be held or supported by the sheet-catching devices. This is especially true in the case of stiff cardboard sheets. A consequence thereof is that the paper sheets slide off the sheet-catching devices in an undefined manner, when the sheet-pile rake is inserted, thereby causing disruptions of the printing process.

Furthermore, due to the arrangement of the sheet-catching device at a location higher than the upper edge of the delivery pile, the following risks are encountered, when the delivery pile is lowered: Firstly, the printed sheets sag so low that, when the sheet-pile rake is introduced, it is not inserted into a wedge-shaped space, but rather, strikes almost perpendicularly against the firmly held printed sheets which are, thereby, turned or bent over; and secondly, the upper sheets which are not firmly held by the sheet-catching devices are displaced and are superimposed more-or-less in a shingled arrangement. As a result thereof, exact stacking of the sheets on the sheet pile is affected and, in addition, the freshly printed surfaces of the printed sheets become smeared.

SUMMARY OF THE INVENTION

Proceeding from the foregoing problems, it is accordingly an object of the invention, to provide a method and device for realizing non-stop operation at a delivery of a sheet-fed printing press which permits exact stacking of the sheets on the sheet pile and avoids smearing of freshly printed surfaces of the printed sheets by forming a defined wedge-shaped space between a main sheet pile and subsequently produced printed sheets, even at high production speeds.

With the foregoing and other objects in view, there is provided, in accordance with one aspect of the invention, a method of changing sheet piles on a sheet-fed printing press, which includes introducing a sheet pile rake above a main sheet pile for forming an auxiliary sheet pile, further comprises laying at least one rotatably mounted wedge on an upper edge of the main sheet pile so as to form a wedge-shaped space.

In accordance with another mode, the method according to the invention includes lowering the upper edge of the main sheet pile from a production level to the height of the rotatably mounted wedge so that the laying of the wedge on the upper edge of the main sheet pile is performed automatically, and inserting the sheet pile rake into an interspace formed by the rotatably mounted wedge.

In accordance with a further mode, the method according to the invention includes lowering the upper edge of the main sheet pile from a production level to the height of the rotatably mounted wedge, introducing at least one sheet-catching device above the main sheet pile so as to retain thereon subsequently produced printed sheets, and thereby automatically laying the rotatably mounted wedge on the upper edge of the main sheet pile, releasing from the sheet-catching devices the printed sheets which have been produced in the interim, and inserting the sheet pile rake in the wedge-shaped space for-med by the rotatably mounted wedge.

In accordance with another aspect of the invention, there is provided a device for changing sheet piles on a sheet-fed printing press which produces printed sheets, wherein a sheet-pile rake is introducible above a main pile of previously produced printed sheets for forming an auxiliary pile of subsequently produced printed sheets, comprising at least one wedge mounted on a shaft for forming a wedge-shaped space between the main sheet pile and subsequently produced printed sheets.

In accordance with another feature of the invention, the wedge is formed with sides converging to a point spaced from the middle of the shaft a distance which is from one to three times the diameter of the shaft.

In accordance with a further feature of the invention, the wedge is secured to a sleeve and is rotatably mounted, the wedge being formed with two sides of which one side extends substantially tangentially to the sleeve, and the other side extends substantially perpendicularly to a tangent to the sleeve.

In accordance with an added feature of the invention, the wedge is formed with sides defining a tip of the wedge, the tip being rounded off.

In accordance with an additional feature of the invention, the wedge is rotatably mounted, and an actuator is provided for inserting the rotatably mounted wedge between an upper edge of the main sheet pile and the subsequently produced printed sheets.

In accordance with yet another feature of the invention, the actuator is an electric motor.

In accordance with an alternative feature of the invention, the actuator is a rotary magnet.

In accordance with a concomitant alternative feature, the actuator is a pneumatic or hydraulic cylinder.

A wedge or a plurality of wedges are thus rotatably mounted on a shaft extending parallel to the leading edge of the delivery pile and, together with sheet joggers which are fastened to the shaft, executing a cyclic rocking movement in order to jog the leading edge of the print sheets. As viewed from near the diameter of the shaft, the wedge is shaped so as to narrow towards a point. The advantage of such a wedge is that, when rotated, it may be laid on the upper side of the main sheet pile, a wedge-shaped space being thereby formed between the subsequently produced printed sheets and the main sheet pile, and the wedge-shaped space being maintained almost unchanged, when the main sheet pile is lowered. Below the shaft, the sheet-pile or stacking rake is then inserted into the flat wedge-shaped space formed by the rotatably mounted wedges. The flat wedge-shaped space eliminates the risk that the printed sheets lying on the wedges may slip off.

A further advantage of the rotatably mounted wedge is that, after the sheet pile rake has been introduced, and when the main sheet pile is being lowered, respectively, the wedge rotates out of the sheet pile region by itself. When the pallet moves upwards in order to form a new main sheet pile and when the sheet-pile rake is being withdrawn, the wedge does not cause any disruptive effects.

The rotatably mounted wedge or the rotatably mounted wedges may be laid manually or automatically on the upper edge of the main sheet pile. For manual operation, the pressman holds back the subsequently printed sheets manually, i.e., with his hand, and lays the rotatably mounted wedge or wedges on the upper edge of the main sheet pile. For automatic operation, the wedge or wedges are automatically laid on the upper edge of the main sheet pile by means of an actuator, such as a rotary magnet, a pneumatic or hydraulic element, an electric motor, or the like, at the instant of time at which the sheet piles are changed. This automation may be effected in combination with a prior-art sheet-catching device constructed for removing sample or test sheets. As viewed from the leading edge of the main sheet pile, the sheet-catching devices are moved between the main sheet piles and the arriving printed sheets. In this regard, an underpressure or negative pressure exists at the surface of the sheet catchers which holds and retains the arriving sheets. When sheet piles are being changed, the sheet-catching devices are needed, i.e. inserted between the main sheet pile and the arriving sheets, only so long until the upper edge of the main sheet pile has been lowered to the level of the shaft with the rotatably mounted wedges, which are mounted thereon, lying on the upper edge of the main sheet pile. When the wedges lie on the upper edge of the main sheet pile, the sheet-catching devices may be withdrawn. Then, the sheet-pile rake is inserted and the sheet piles are changed in the aforementioned manner.

If the rotatably mounted wedges are laid or deposited rapidly enough between two printed sheets which are to be deposited, the assistance of the sheet-catching devices can be dispensed with.

Other features which are considered as characteristic for the invention are set forth in the appended claims.

Although the invention is illustrated and described herein as as a method and device for realizing non-stop operation at a delivery of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
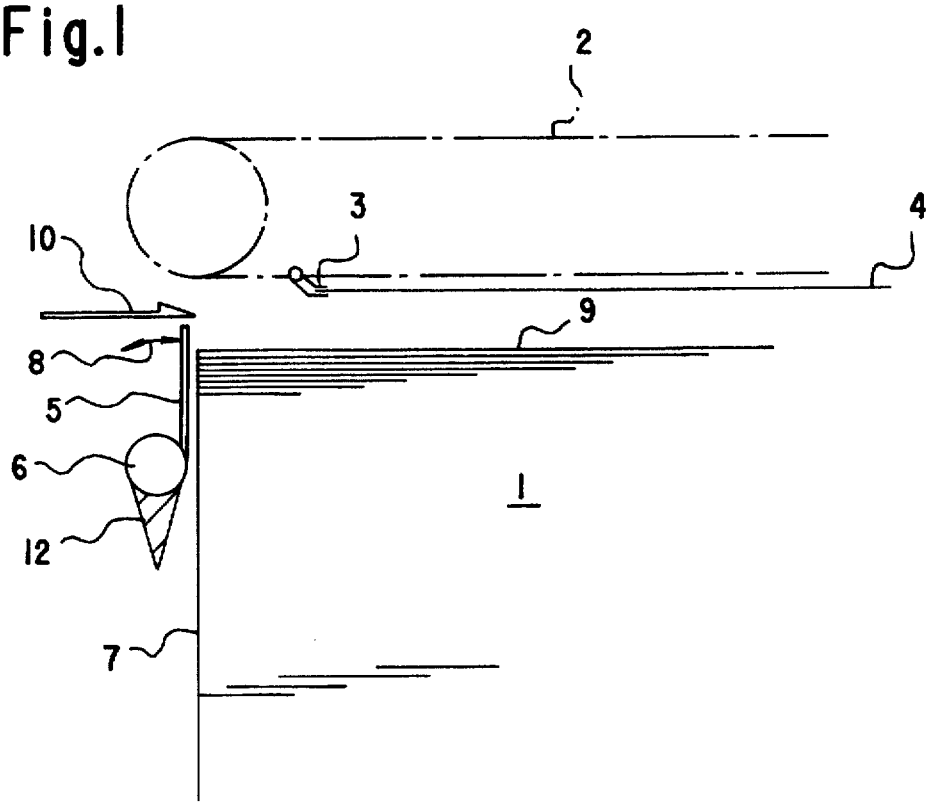
FIG. 1 is a fragmentary diagrammatic side elevational view of a sheet-delivery showing a delivery pile during normal production.

Referring now to the drawings and, first, particularly to FIG. 1, there is shown therein a delivery of a sheet-fed printing press including a main sheet pile 1, a chain conveyor 2 revolving over the main sheet pile 1 for conveying printed sheets 4 by means of grippers 3 out of a non-illustrated last printing unit of a sheet-fed printing press. The grippers 3 are opened by means of a non-illustrated conventional gripper-opening device, and release the printed sheet 4 to be deposited on the main sheet pile 1. By means of likewise non-illustrated conventional braking devices, the print sheets 4 are guided in a controlled manner against stops 5 vertically fastened to a shaft 6. In order to align the printed sheets exactly at the the leading edges 7 thereof, the shaft 6 may be tilted as indicated by arrow 8. The main sheet pile 1 executes a downward movement, which depends upon or is in accordance with the thickness of the printed sheets and the production speed, in order to keep the upper edge 9 of the main sheet pile 1 at a constant level.

Figure 2:
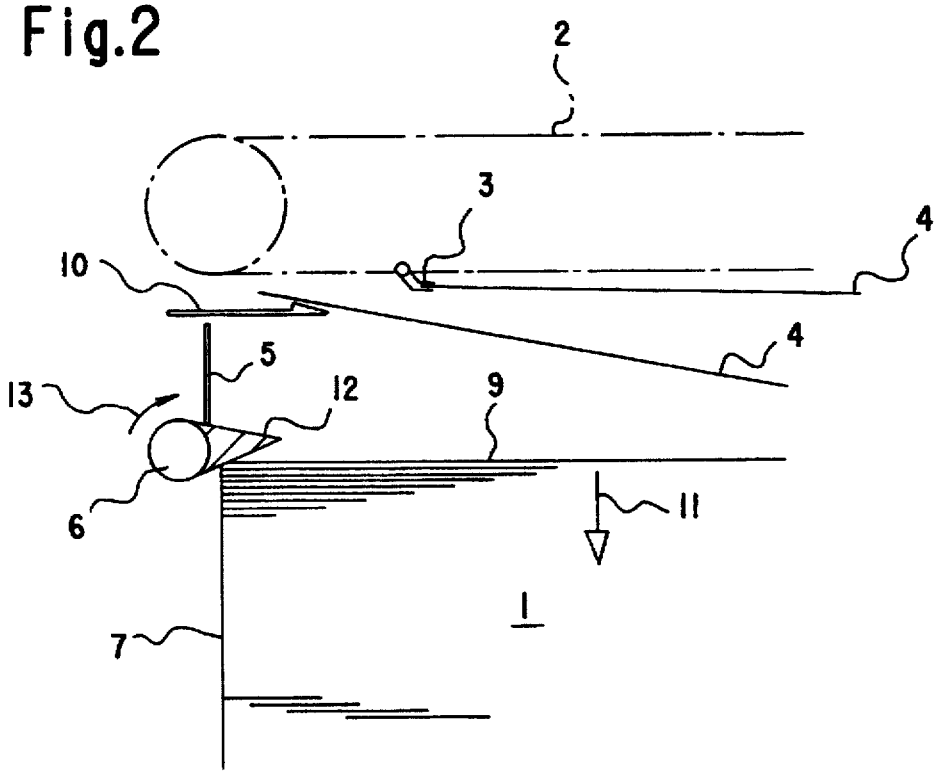
FIG. 2 is a view like that of FIG. 1 in another operating phase wherein sheet-catching devices have been introduced, and a main sheet pile being lowered with inserted wedges.

FIG. 2 shows the preparations necessary for changing sheet piles. In this regard, a sheet-catching device 10 is moved underneath the revolving chain conveyor 2 into the sheet pile region in order, initially, to form a wedge-shaped space between the main sheet pile 1 and the subsequently produced printed sheets 4. An underpressure or negative pressure is present on the surface of the sheet-catching device 10 and sucks and holds a respective printed sheet 4. The main sheet pile 1 is lowered at high speed as indicated by the arrow 11. If the level of the upper edge of the main sheet pile 1 is at the same height as that of the shaft 6, the rotatably mounted wedge or wedges 12, only one of which is shown in the drawing, are laid upon the upper edge 9 of the main sheet pile 1 as indicated by the arrow 13.

Figure 3:
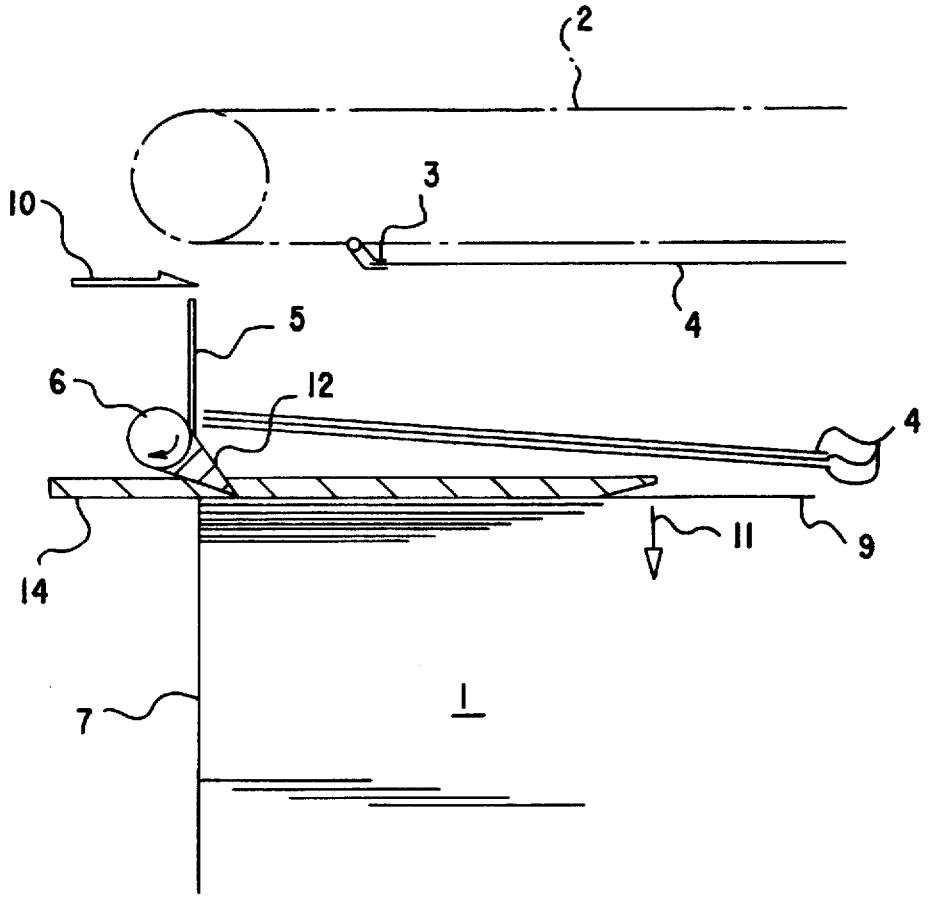
FIG. 3 is a view like those of FIGS. 1 and 2 in a further operating phase wherein sheet-catching devices have again been withdrawn, and a sheet-pile rake being introduced above the main sheet pile.

FIG. 3 shows the main sheet pile 1 which has been lowered farther down, as indicated by the arrow 11, so that the level of the upper edge 9 of the main sheet pile 1 is below the shaft 6. The sheet-catching device 10 has again released the printed sheets 4 which have been produced after the sheet-catching device 10 had been introduced in accordance with FIG. 2, and is then in a rest position thereof. The wedges 12 then form, between the main sheet pile 1 and the printed sheets 4, the wedge-shaped space which is necessary for inserting the sheet pile rake 14. By further lowering the main sheet pile 1, and due to the pressure applied by the printed sheets from above against the wedges 12, the latter are automatically rotated out of the sheet pile region and into the rest position thereof according to FIG. 1. The main sheet pile 1 may then be removed from beneath the sheet pile or stacking rake 14 in a conventional manner. A non-illustrated conventional pallet is then moved to the level of the sheet pile rake 14 by means of a likewise non-illustrated conventional pile-lifting device in order to withdraw the sheet pile rake 14. Then, the upper edge 9 of the main sheet pile 1 adjusts itself to the production level according to FIG. 1 and keeps it at a constant value as a function of the thickness of the print sheets and the production speed.

For automatic operation of the device according to the invention, the wedge or wedges 12 are laid on the upper edge 9 of the main sheet pile 1 by means of an electric motor 20 as represented in FIG. 1, a rotary magnet 21 as represented in FIG. 2, a pneumatic or hydraulic cylinder 22 as represented in FIG. 3, or an equivalent actuating mechanism at the instant of time at which the sheet piles are changed.

Figure 4:
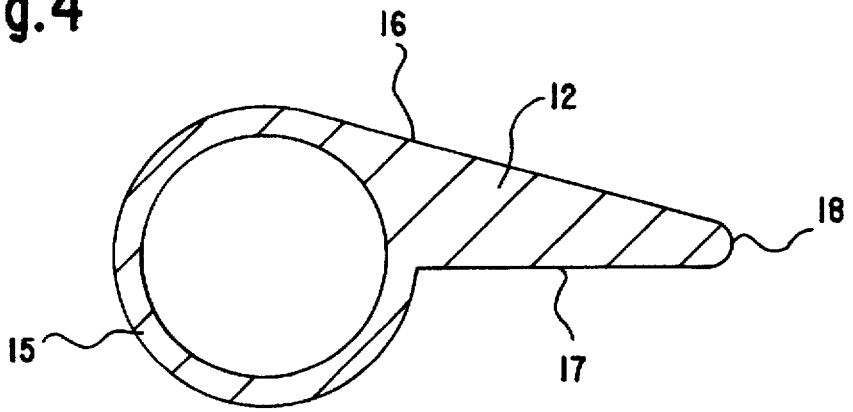
FIG. 4 is an enlarged sectional view of one conceivable exemplary embodiment of the wedges shown in FIGS. 1 to 3.

FIG. 4 shows a conceivable exemplary embodiment of the journalled, i.e., rotatably mounted, wedge 12. The rotatable mounting or journal is provided by a sleeve 15 which, at the same time, receives the shaft 6 therein. In an upper part thereof, as viewed in FIG. 4, the exemplary embodiment has a side 16 extending substantially tangentially to the outer diameter of the sleeve 15. In a lower part of the embodiment shown in FIG. 4, a side 17 is provided thereon which more-or-less forms a right angle with a tangent to the sleeve 15. A tip 18 at which the two sides 16 and 17 converge is rounded off.

We claim:

1. Method of changing sheet piles on a sheet-fed printing press, which comprises introducing a sheet pile rake above a main sheet pile for forming an auxiliary sheet pile, and laying at least one rotatably mounted wedge capable of rotating through 360 degrees on an upper edge of the main sheet pile so as to form a wedge-shaped space.

2. Method according to claim 1, which includes lowering the upper edge of the main sheet pile from a production level to the height of the rotatably mounted wedge so that the laying of the wedge on the upper edge of the main sheet pile is performed automatically, and inserting the sheet pile rake into an interspace formed by the rotatably mounted wedge.

3. Method according to claim 1, which includes lowering the upper edge of the main sheet pile from a production level to the height of the rotatably mounted wedge, introducing at least one sheet-catching device above the main sheet pile so as to retain thereon subsequently produced printed sheets, and laying the rotatably mounted wedge on the upper edge of the main sheet pile, releasing from the sheet-catching devices the printed sheets which have been produced in the interim, and inserting the sheet pile rake in the wedge-shaped space for-med by the rotatably mounted wedge.

4. Device for changing sheet piles on a sheet-fed printing press which produces printed sheets, comprising:

a shaft;

at least one wedge mounted on said shaft for forming a wedge-shaped space between a main sheet pile and subsequently produced printed sheets, said wedge being rotatable through 360 degrees around said shaft;

a sheet-pile rake to be introduced above the main pile of previously produced printed sheets for forming an auxiliary pile from the subsequently produced printed sheets.

5. Device according to claim 4, wherein said wedge is formed with sides converging to a point spaced from the middle of said shaft a distance which is from one to three times the diameter of said shaft.

6. Device according to claim 4, including a sleeve said wedge being secured to said sleeve and rotatably mounted, said wedge being formed with two sides of which one side extends substantially tangentially to said sleeve, and the other side extends substantially perpendicularly to a tangent to said sleeve.

7. Device according to claim 4, wherein said wedge is formed with sides defining a tip of said wedge, said tip being rounded off.

8. Device according to claim 4, including an actuator for inserting said rotatably mounted wedge between an upper edge of the main sheet pile and the subsequently produced printed sheets.

9. Device according to claim 8, wherein said actuator is an electric motor.

10. Device according to claim 8, wherein said actuator is a rotary magnet.

11. Device according to claim 8, wherein said actuator is a pneumatic or hydraulic cylinder.

* * * * *